US009790053B2

(12) United States Patent
Kuroda

(10) Patent No.: US 9,790,053 B2
(45) Date of Patent: Oct. 17, 2017

(54) ELEVATOR DEVICE

(75) Inventor: Shinichi Kuroda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 451 days.

(21) Appl. No.: 14/406,027

(22) PCT Filed: Jul. 18, 2012

(86) PCT No.: PCT/JP2012/068209
§ 371 (c)(1),
(2), (4) Date: Dec. 5, 2014

(87) PCT Pub. No.: WO2014/013569
PCT Pub. Date: Jan. 23, 2014

(65) Prior Publication Data
US 2015/0151947 A1 Jun. 4, 2015

(51) Int. Cl.
*B66B 1/18* (2006.01)
*B66B 1/46* (2006.01)

(52) U.S. Cl.
CPC ..... *B66B 1/468* (2013.01); *B66B 2201/4638* (2013.01); *B66B 2201/4676* (2013.01)

(58) Field of Classification Search
CPC ..... B66B 1/468; B66B 2201/4638; B66B 2201/4676
(Continued)

(56) References Cited

U.S. PATENT DOCUMENTS 4,838,384 A * 6/1989 Thangavelu ..... B66B 1/2458 187/385
5,329,076 A * 7/1994 Kameli ..... B66B 1/2408 187/383
(Continued)

FOREIGN PATENT DOCUMENTS

CN 101959781 A 1/2011
JP 2001-206649 A 7/2001
(Continued)

OTHER PUBLICATIONS

International Search Report dated Sep. 4, 2012 in PCT/JP2012/068209 Filed Jul. 18, 2012.
(Continued)

*Primary Examiner* — Anthony Salata
(74) *Attorney, Agent, or Firm* — Oblon, McClelland, Maier & Neustadt, L.L.P.

(57) ABSTRACT

An elevator device includes: a first reader, a second reader, a determination section, and a request output section. The first reader is provided in a hall of an elevator. The second reader is provided in a car of the elevator. In the case where identification information has been read by the first reader, the determination section determines whether or not the identification information has been read by the second reader before the reading thereof by the first reader. On the basis of the identification information read by the first reader, the request output section outputs a registration request for a call to a control section. In the case where the determination section determines that the identification information has been read by the second reader, the request output section does not output a registration request for a call corresponding to the identification information to the control section.

10 Claims, 4 Drawing Sheets

(58) Field of Classification Search
USPC ..... 187/247, 380–389, 391, 392, 393
See application file for complete search history.

(56) References Cited

U.S. PATENT DOCUMENTS

| | | | | |
|---|---|---|---|---|
| 5,511,634 | A * | 4/1996 | Bahjat | B66B 1/2458 187/383 |
| 6,152,265 | A * | 11/2000 | Bittar | B66B 1/20 187/382 |
| 6,209,685 | B1 * | 4/2001 | Zaharia | B66B 1/468 187/381 |
| 6,237,721 | B1 * | 5/2001 | Siikonen | B66B 1/2458 187/382 |
| 6,707,374 | B1 * | 3/2004 | Zaharia | B66B 1/468 187/392 |
| 7,190,256 | B2 * | 3/2007 | Pieper | B66B 1/468 340/5.2 |
| 8,061,485 | B2 * | 11/2011 | Finschi | B66B 1/468 187/384 |
| 8,525,652 | B2 * | 9/2013 | Takeuchi | B66B 1/468 187/247 |
| 9,323,232 | B2 * | 4/2016 | Blom | G05B 13/00 |
| 9,463,954 | B2 * | 10/2016 | Kumar | B66B 1/468 |
| 2010/0315208 | A1 | 12/2010 | Takeuchi | |
| 2015/0210505 | A1 * | 7/2015 | Fujiwara | B66B 1/468 187/381 |

FOREIGN PATENT DOCUMENTS

| | | | |
|---|---|---|---|
| JP | 2003-341945 | A | 12/2003 |
| JP | 2005-255320 | A | 9/2005 |
| JP | 2005-335943 | A | 12/2005 |
| JP | 2006-76697 | A | 3/2006 |
| JP | 2009-196814 | A | 9/2009 |
| JP | 2012-131607 | A | 7/2012 |
| WO | WO 2009/107206 | A1 | 9/2009 |

OTHER PUBLICATIONS

Office Action dated Jul. 18, 2016 in Korean Patent Application No. 10-2015-7001232 with English translation.
Office Action dated Jan. 24, 2017 in Korean Patent Application No. 10-2015-7001232 (with English language translation).
Office Action dated May 12, 2015 in Japanese Patent Application No. 2014-525603 (with partial English language translation).
International Preliminary Report on Patentability and Written Opinion dated Jan. 29, 2015 in PCT/JP2012/068209.
Office Action dated Jul. 21, 2017, in Korean Patent Application No. 10-2015-7001232 (with English language translation).

* cited by examiner

No. 10 : AUTHENTICATION DEVICE
No. 11 : DESTINATION CALL BUTTON
No. 14 : STORAGE DEVICE
No. 15 : CONTROL SECTION
No. 16 : LIST CREATION SECTION
No. 17 : DETERMINATION SECTION
No. 18 : REQUEST OUTPUT SECTION

No. 10 : AUTHENTICATION DEVICE
No. 14 : STORAGE DEVICE
No. 15 : CONTROL SECTION
No. 16 : LIST CREATION SECTION
No. 17 : DETERMINATION SECTION
No. 18 : REQUEST OUTPUT SECTION
No. 20 : DETECTION SECTION
No. 21 : DETERMINATION SECTION

S207:COUNTER VALUE>THRESHOLD VALUE?

ELEVATOR DEVICE

TECHNICAL FIELD

The present invention relates to an elevator device.

BACKGROUND ART

Conventional techniques of an elevator device are disclosed in Patent Literature 1 and Patent Literature 2.

In the elevator described in Patent Literature 1, a reader is installed in a hall. The reader reads information for identifying individuals (identification information) from a tag carried by an elevator user. When the reader reads identification information, a destination call is automatically registered.

The elevator described in Patent Literature 1 has the problem that unnecessary calls are registered. For example, when a user alights from a car, a reader installed in a hall reads identification information from a tag carried by the user. There has been a case where a destination call of the user is registered again when the user alights from the car.

A configuration for solving the above-described problem is disclosed in Patent Literature 2.

In the elevator described in Patent Literature 2, a reader is installed in halls and a car. When the reader in a hall reads identification information, a destination call is automatically registered. When a user boards the car, the reader of the car reads identification information from a tag of the user. When the reader of the car becomes incapable of reading specific identification information, the registration of a destination call is prohibited until a given time elapses after it becomes impossible to read the identification information.

CITATION LIST

Patent Literature

Patent Literature 1: Japanese Patent Laid-Open No. 2005-255320

Patent Literature 2: International Publication No. WO2009/107206

SUMMARY OF INVENTION

Technical Problem

A reader is such that the range in which identification information can be read from a tag (a read range) is limited. That is, a reader reads identification information from a tag present in a read range.

In the case where a reader of a hall is arranged near the entry of the hall, when a car stops at the hall, the read range of the reader of the hall and the read range of the reader of the car overlap partially. There have been cases where both the reader of the car and the reader of the hall read identification information from the tag of the same user when the user alights from the car. In such a case, in the elevator described in Patent Literature 2, a destination call of a user who is going to alight from the car is automatically registered.

The present invention was made in order to solve the problem described above, and an object of the present invention is to provide an elevator device which is capable of positively preventing a destination call of a user who is going to alight from a car from being automatically registered.

Solution to Problem

An elevator device of the present invention is a device which comprises a first reader which is provided in a hall of an elevator and reads identification information which an information recording medium has, a second reader which is provided in a car of the elevator and reads the identification information which the information recording medium has, a request output section which outputs a registration request for a call to a control section of the elevator on the basis of the identification information read by the first reader, and a first determination section which, in the case where the identification information has been read by the first reader, determines whether or not the identification information has been read by the second reader before the reading of the identification information by the first reader. The request output section does not output a registration request for a call corresponding to the identification information to the control section in the case where the first determination section determines that the identification information has been read by the second reader.

Also, an elevator device of the present invention is a device which comprises a first reader which is provided in a hall of an elevator and reads identification information which an information recording medium has, a second reader which is provided in a car of the elevator and reads the identification information which the information recording medium has, a control section which performs a call registration on the basis of the identification information read by the first reader, and a first determination section which, in the case where the identification information has been read by the first reader, determines whether or not the identification information has been read by the second reader before the reading of the identification information by the first reader. The control section does not perform a call registration corresponding to the identification information in the case where the first determination section determines that the identification information has been read by the second reader.

Advantageous Effects of Invention

According to the present invention, it is possible to positively prevent a destination call of a user who is going to alight from a car from being automatically registered.

DESCRIPTION OF EMBODIMENTS

Figure 1:
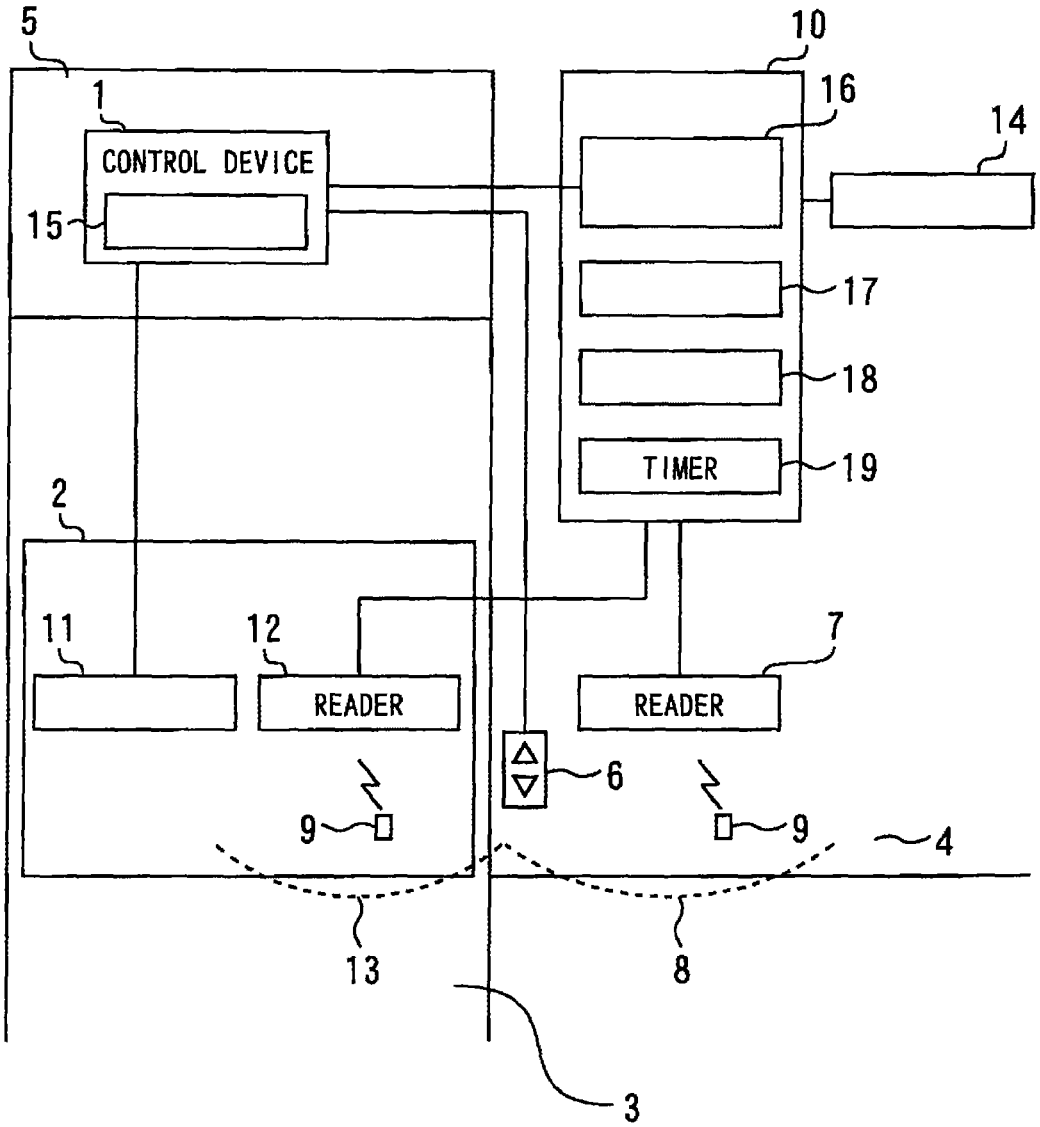
FIG. 1 is a configuration diagram showing an elevator device according to a first embodiment of the present invention.

The present invention will be described in detail with reference to the accompanying drawings. In each of the drawings, identical reference numerals refer to identical or corresponding parts. Redundant descriptions are appropriately simplified or omitted.

First Embodiment

FIG. 1 is a configuration diagram showing an elevator device according to a first embodiment of the present invention.

A control device 1 controls the operation of an elevator. For example, the control device 1 causes a car 2 to ascend and descend in a shaft 3 by controlling a drive unit (not shown). The control device 1 stops the car 2 according to the height of a hall 4 of the elevator. On stopping the car 2 at the hall 4, the control device 1 causes a door to be opened and closed. While the door is open, users of the elevator can board the car 2 from the hall 4 or alight from the car 2 onto the hall 4.

The control device 1 is installed, for example, in a machine room 5 provided above the shaft 3. The control device 1 may be installed in the shaft 3.

In FIG. 1 is shown the hall 4 on the top floor of the building. The hall 4 is provided on each floor of the building. The hall 4 may be provided on only some of the floors of the building.

A hall button 6 and a reader 7 are provided in the hall 4.

The hall button 6 is a button which a user operates in registering a hall call. The hall button 6 is provided in a hall operating panel (not shown). The hall button 6 includes, for example, an up button and a down button. When a user pushes the up button, a registration request for a hall call is outputted from the hall operating panel to the control device 1. When a user pushes the down button, a registration request for a hall call is outputted from the hall operating panel to the control device 1. On the basis of the registration request inputted from the hall operating panel, the control device 1 registers a hall call.

The reader 7 reads identification information from a tag 9 present in a read range 8. The read range 8 is a range in which the reader 7 can read information from the tag 9. The read range 8 is set beforehand so that information can be read from the tag 9 in the vicinity of the hall entrance, for example.

The tag 9 is carried by a person who uses the elevator. Identification information is stored beforehand in the tag 9. Identification information is information for identifying the tag 9 (the person who carries the tag 9). In the case where the tag 9 is present in the read range 8, the reader 7 reads the identification information which the tag 9 has by radio communication. On reading identification information from the tag 9, the reader 7 outputs information on the reader itself and the read identification information to an authentication device 10. The information on the reader itself is information for identifying readers 7 individually. That is, by receiving the above-described information from the reader 7, the authentication device 10 can identify which reader 7 has read the identification information from which tag 9.

A destination call button 11 and a reader 12 are provided in the car 2.

The destination call button 11 is a button which a user operates in registering a destination call. The destination call button 11 is provided in a car operating panel (not shown). The destination call button 11 includes, for example, a button for each of the floors at which the car 2 stops. When a user presses the destination call button 11, a registration request for a destination call is outputted from the car operating panel to the control device 1. On the basis of the registration request inputted from the car operating panel, the control device 1 registers a destination call. For example, when a user presses the destination call button 11 of the third floor, the control device 1 registers a destination call for the third floor.

The reader 12 reads identification information from a tag 9 present in a read range 13. The read range 13 is a range in which the reader 12 can read information from the tag 9. The read range 13 is set beforehand so that, for example, information can be read from all tags 9 present in the interior of the car 2. Part of the read range 13 may overlap with part of the read range 8 when the car 2 stopped at the hall 4.

In the case where a tag 9 is present in the read range 13, the reader 12 reads the identification information which the tag 9 has by radio communication. On reading identification information from the tag 9, the reader 12 outputs information on the reader itself and the read identification information to the authentication device 10. The information on the reader itself is information for identifying readers 12 individually. That is, by receiving the above-described information from the reader 12, the authentication device 10 can identify from which tag 9 the reader 12 has read the identification information. In the case where there are a plurality of cars 2, the authentication device 10 can identify which reader 12 has read the identification information from which tag 9.

The tag 9 is an example of an information recording medium having identification information. Examples of the tag 9 include a passive type IC tag, an active type IC tag, and RF tag and the like. The information recording medium may be a medium other than tags so long as the information recording medium has identification information. The information recording medium may be, for example, a cellular phone or a dedicated terminal.

The authentication device 10 is connected to the reader 7 and the reader 12. Also, the authentication device 10 is connected to the control device 1. The authentication device 10 has the function of outputting a call registration request to the control device 1. On the basis of the information inputted from the reader 7 and the information inputted from the reader 12, the authentication device 10 outputs a call registration request.

Information required by the authentication device 10 in performing various kinds of processing is stored in a storage device 14. The storage device 14 may be provided as part of the authentication device 10. A users list is stored in the storage device 14. In the users list, identification information of tags 9 and information on service floors are registered in a correlated manner. That is, on the basis of the contents registered in the users list, the authentication device 10 can specify to which floor a person who carries a tag 9 wants to go.

Table 1 shows an example of a users list.

TABLE 1

| Identification information | Service floor |
|---|---|
| 001 | 4 |
| 002 | 5 |
| 003 | 2 |

Consider an example of the case where a person who carries a tag 9 wants to use an elevator and has come from a room in the building to the hall 4 on the third floor.

When the user has arrived at the hall 4 on the third floor 3, identification information is read by the reader 7 provided in the hall 4 from the tag 9 of the user. The reader 7 which has read the identification information outputs the information on the reader itself and the read identification information to the authentication device 10. On the basis of the information inputted from the reader 7, the authentication device 10 outputs a registration request for a hall destination call to the control device 1. On the basis of the registration request inputted from the authentication device 10, a control section 15 included in the control device 1 registers a hall call and a destination call. That is, the control section 15 stops the car 2 at the hall 4 on the third floor and causes the user to board the car 2. After that, the control section 15 stops the car 2 at the service floor which has been registered beforehand by the user and causes the user to alight from the car 2.

In alighting from the car 2 onto the hall 4, the user passes through the read range 8 of the reader 7 provided in the hall 4. For this reason, when the user alights from the car 2 onto the hall 4, the reader 7 provided in the hall 4 reads identification information from the tag 9 of the user. The reader 7 which has read the identification information outputs the information on the reader itself and the read identification information to the authentication device 10. At this time, the authentication device 10 does not output a registration request for a hall destination call. That is, in the case where the reader 7 has read identification information from the tag 9 of the user immediately after alighting from the car 2, the authentication device 10 does not output a registration request for a call.

In order to realize this function, the authentication device 10 includes a list creation section 16, a determination section 17, a request output section 18, and a timer 19.

The list creation section 16 creates various lists. The list creation section 16 creates, for example, an on-board passengers list, a waiting passengers list, and an alighting passengers list. Information on persons boarding the car 2 is registered in the on-board passengers list. For example, the list creation section 16 registers identification information read by the reader 12 in the on-board passengers list. The on-board passengers list is updated in a given cycle. In a system in which a plurality of elevators are group-controlled, the on-board passengers list is created for each car 2.

Information on persons in the hall 4 is registered in the waiting passengers list. For example, the list creation section 16 registers identification information read by the reader 7 in the waiting passengers list. The waiting passengers list is updated in a given cycle. The waiting passengers list is created for each hall 4 in which the reader 7 is installed.

Information on persons who have alighted from the car 2 onto the hall 4 is registered in the alighting passengers list. For example, the list creation section 16 registers, in the alighting passengers list, identification information read by the reader 12 before the reading thereof by the reader 7 among the identification information read by the reader 7. The alighting passengers list is updated in a given cycle. The alighting passengers list is created for each hall 4 in which the reader 7 is installed.

The determination section 17 determines, in the case where identification information has been read by the reader 7, whether or not the identification information has been read by the reader 12 before the reading thereof by the reader 7. The determination section 17 performs the determination, for example, on the basis of lists created by the list creation section 16.

The request output section 18 outputs a registration request for a call to the control device 1 (specifically, the control section 15). On the basis of identification information read by the reader 7, the request output section 18 outputs a registration request for a call. In the case where it is expected that the reader 7 has read identification information from a tag 9 of a user who alighted from the car 2, the request output section 18 does not output a registration request for a call corresponding to the identification information even when the identification information has been read by the reader 7. For example, the request output section 18 does not perform the output of a registration request regarding the identification information determined by the determination section 17 to have been read by the reader 12.

Figure 2:
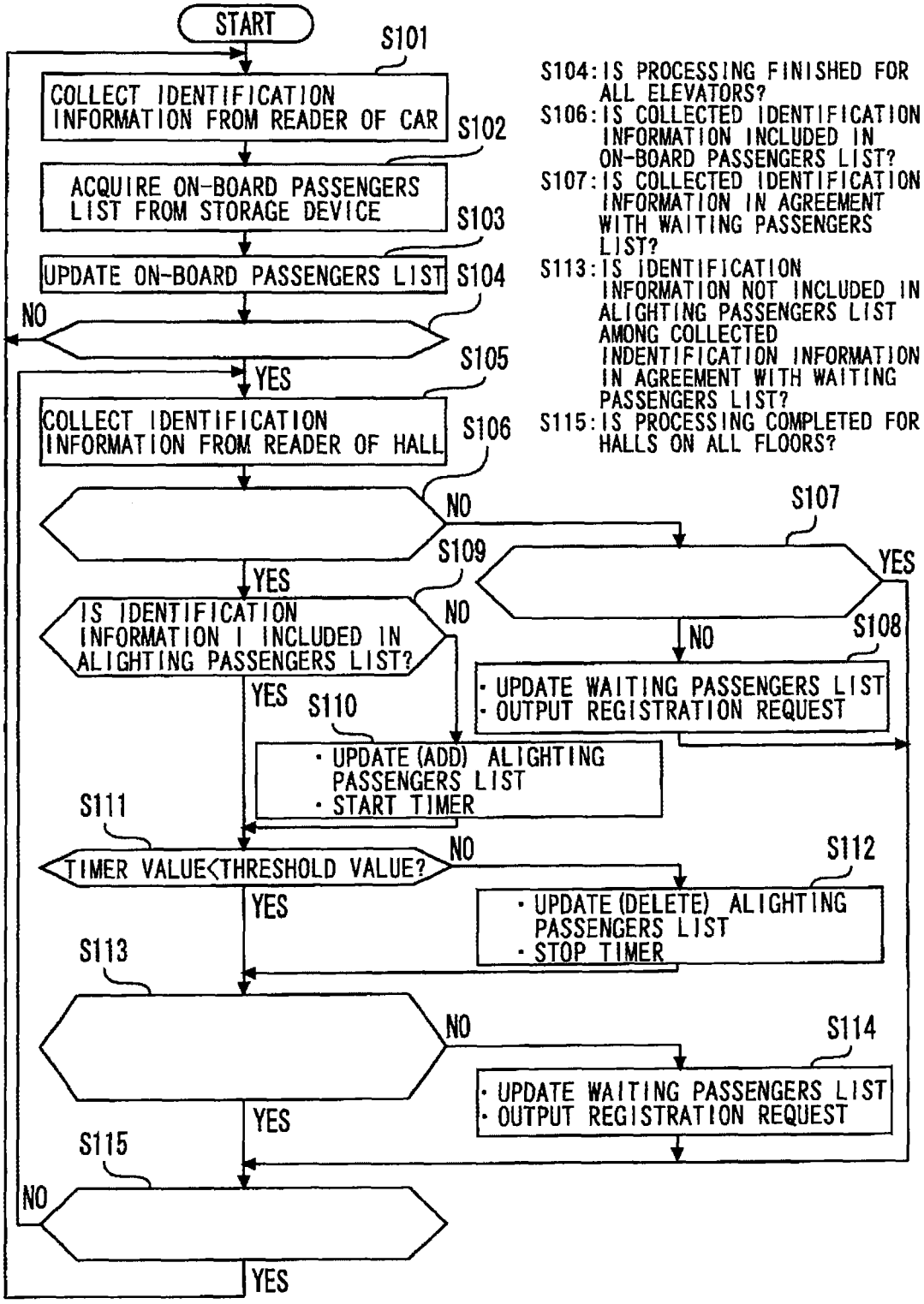
FIG. 2 is a flowchart showing actions of the elevator device according to the first embodiment of the present invention.

FIG. 2 is a flowchart showing actions of the elevator device according to the first embodiment of the present invention. In the following, referring to also FIG. 2, the contents of specific processing performed by the authentication device 10 will be described.

In the following, the description is given on the assumption that all users carry a tag 9. Furthermore, it is assumed that when the car 2 stops at the hall 4, part of the read range 13 overlaps with part of the read range 8.

The authentication device 10 collects identification information from the reader 12 provided in the car 2 (S101). The authentication device 10 acquires an on-board passengers list from the storage device 14 (S102). On the basis of the information acquired in S101 and S102, the list creation section 16 updates the on-board passengers list (S103). For example, in the case where identification information not contained in the on-board passengers list has been acquired in S101, the list creation section 16 adds the identification information to the on-board passengers list. In the case where identification information contained in the on-board passengers list has not been acquired in S101, the list creation section 16 deletes the identification information from the on-board passengers list. The list creation section 16 causes the storage device 14 to store the updated on-board passengers list.

In the case where the control device 1 controls the operation of a plurality of elevators, the authentication device 10 determines whether or not the processing of S101 to S103 has been performed for all cars 2 (S104). The authentication device 10 performs the processing of S101 to S103 for each car 2.

The processing of S104 may be omitted if there is only one car 2.

When the processing of S101 to S103 is performed for all cars 2, the authentication device 10 collects identification information from the reader 12 installed in a hall 4 (S105). Furthermore, the authentication device 10 acquires the on-board passengers list from the storage device 14.

Next, the determination section 17 determines whether or not the identification information included in the on-board passengers list was acquired in S105 (S106). Unless a user in the car 2 has alighted onto the hall 4, in S106 the result of the determination is NO. In this case, the authentication device 10 acquires a waiting passengers list from the storage device 14. The determination section 17 determines whether or not the identification information collected in S105 is in agreement with the identification information included in the waiting passengers list (S107). Unless there are comings and goings of passengers in the hall 4, in S107 a determination is performed to the effect that the two are in agreement. In this case, the list creation section 16 does not update the waiting passengers list. After that, the processing by the authentication 10 proceeds to the processing of S115.

When it is determined in S107 that the two are not in agreement, the list creation section 16 updates the waiting passengers list (S108). For example, in the case where identification information not included in the waiting passengers list was acquired in S105, the list creation section 16 adds the identification information to the waiting passengers list. When the identification information is newly added to the waiting passengers list, the request output section 18 outputs a registration request for a hall destination call corresponding to the identification information to the control device 1 (S108). In the case where the identification information included in the waiting passengers list was not acquired in S106, the list creation section 16 deletes the identification information from the waiting passengers list. The list creation section 16 causes the storage device 14 to store the updated waiting passengers list. After that, the processing by the authentication 10 proceeds to the processing of S115.

When a user in the car 2 alights onto the hall 4, in S106 the result of the determination is YES. In this case, the authentication device 10 acquires an alighting passengers list from the storage device 14. In the following, identification information included in the on-board passengers list among the identification information acquired in S105 is referred to as "identification information I."

In S101 identification information I was read by the reader 12 immediately before the reading thereof by the reader 7 in S105. In this case, the request output section 18 does not send a registration request for a call to the control device 1. In S106 the determination section 17 may make a comparison between the identification information acquired in S105 and the identification information included in the on-board passengers list created within a given time immediately before that. With this configuration, for a period after the alighting of a user from the car 2 until the above-described given time elapses, it is possible to prevent a call to this user from being registered.

The determination section 17 determines whether or not identification information I is included in the alighting passengers list (S109). If identification information I is included in the alighting passengers list, the processing by the authentication device 10 proceeds to the processing of S111. If identification information I is not included in the alighting passengers list, the list creation section 16 updates the alighting passengers list (S110). Specifically, the list creation section 16 adds identification information I to the alighting passengers list. When identification information I is added to the alighting passengers list, the determination section 17 starts the timer 19 (S110).

After that, the determination section 17 determines whether or not a given time has elapsed after the start of the timer 19 (S111). If the value of the timer 19 is smaller than a threshold value, the processing by the authentication device 10 proceeds to the processing of S113. If a given time has elapsed after the start of the timer 19, the values of the timer 19 becomes not less than the threshold value. In this case, the list creation section 16 updates the alighting passengers list (S112). Specifically, the list creation section 16 deletes identification information I from the alighting passengers list. When identification information I has been deleted from the alighting passengers list, the determination section 17 stops the timer 19 (S112).

After that, the determination section 17 determines whether or not the identification information not included in the alighting passengers list among the identification information acquired in S105 is in agreement with the identification information included in the waiting passengers list (S113). If in S113 a determination is performed to the effect that the two are in agreement, the processing by the authentication device 10 proceeds to the processing of S115. In S113 a determination is performed to the effect that the two are not in agreement in the case where when a user alights from the car 2 onto the hall 4, another user arrives at the hall 4 simultaneously. In this case, the list creation section 16 updates the waiting passengers list (S114).

In the following, the identification information not included in the alighting passengers list and not in the waiting passengers list either among the identification information acquired in S105 is referred to as "identification information II." Identification information II is identification information read by the reader 7 from the tag 9 carried by the above-described another user.

For example, in S114 the list creation section 16 adds identification information II to the waiting passengers list. The request output section 18 outputs a registration request for a hall destination call corresponding to identification information II to the control device 1. The list creation section 16 causes the storage device 14 to store the updated waiting passengers list.

After that, the authentication device 10 determines whether or not the processing flow shown in S105 to S114 has been carried out for each hall 4 (S115). The authentication device 10 carries out the processing flow shown in S105 to S114 for each hall 4.

With the elevator device having the above-described configuration, when a user is going to alight from the car 2 onto the hall 4, it is possible to positively prevent a call for this user from being registered.

In this embodiment, the authentication device 10 and the control device 1 are configured as separate devices. This is an example. The authentication device 10 may be configured as part of the control device 1. In this case, the control device 1 includes the control section 15, the list creation section 16, the determination section 17, the request output section 18, and the timer 19.

In the case where the authentication device 10 is configured as part of the control device 1, the function of the request output section 18 may be provided in the control section 15. In this case, the control section 15 performs the registration of a call on the basis of identification information read by the reader 7. In the case where it is expected that the reader 7 has read identification information from a tag 9 of a user who alighted from the car 2, the control section 15 does not perform the registration of a call corresponding to the identification information even when the identification information has been read by the reader 7. For example, the control section 15 does not perform the registration of a call regarding the identification information for which the determination section 17 determines that reading by the reader 12 has been performed.

In this embodiment, a concrete description was given of the case where part of the read range 13 overlaps with part of the read range 8 when the car 2 stops at the hall 4. However, this is an example. It is needless to say that the present invention can be applied even to the case where the read range 13 and the read range 8 do not overlap at all when the car 2 stops at the hall 4.

Second Embodiment

Figure 3:
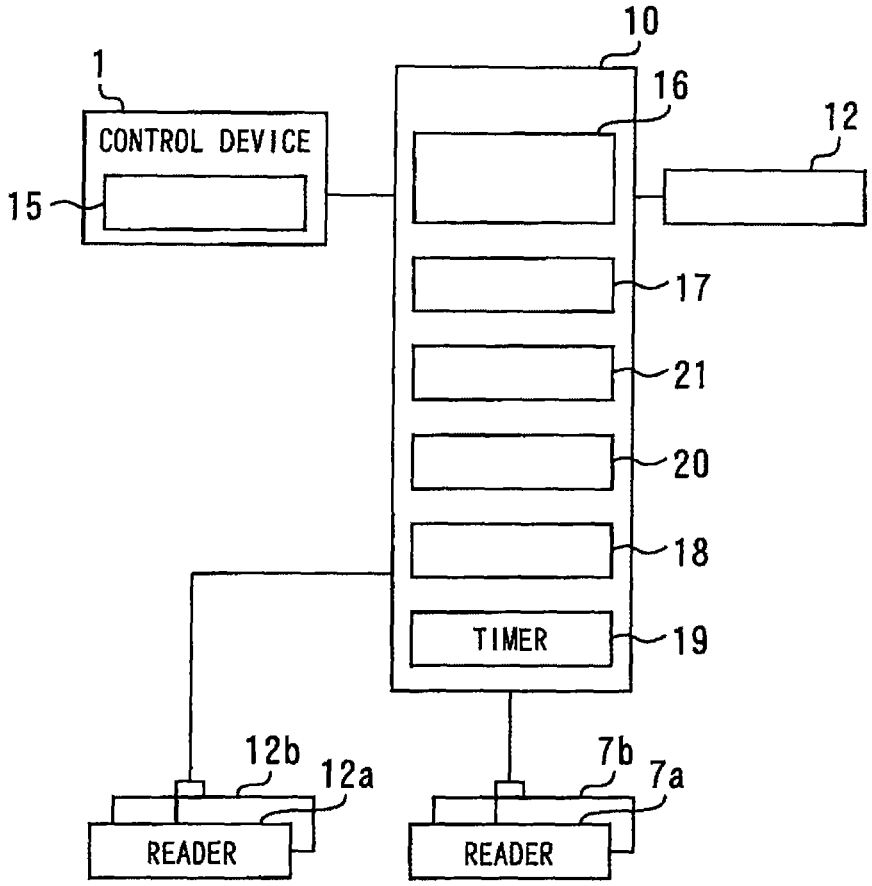
FIG. 3 is a configuration diagram showing the main part of the elevator device according to a second embodiment of the present invention.

FIG. 3 is a configuration diagram showing the main part of the elevator device according to a second embodiment of the present invention. The configuration not disclosed in FIG. 3 is the same as the configuration disclosed in the first embodiment.

In this embodiment, the control device 1 controls a plurality of elevators. In the following, the case where the control device 1 controls two elevators is described. In the case where the control device 1 controls three or more elevators, this description is omitted. In the case where it is necessary to individually specify elevators, "a" or "b" is given behind a symbol. For example, the car of the No. 1 elevator is expressed as "the car 2*a*." The reader provided in the car 2*a* is expressed as "the reader 12*a*." In the case where it is unnecessary to individually specify the car of the No. 1 elevator and the car of the No. 2 elevator, the simple expression "the car 2" is used.

A destination call button 11*a* and a reader 12*a* are provided in the car 2*a* of the No. 1 elevator. If a tag 9 is present in a read range 13*a*, the reader 12*a* reads identification information which the tag 9 has by radio communication. On reading the identification information from the tag 9, the reader 12*a* outputs the information on the reader itself and the read identification information to the authentication device 10.

A destination call button 11*b* and a reader 12*b* are provided in the car 2*b* of the No. 2 elevator. If a tag 9 is present in a read range 13*b*, the reader 12*b* reads identification information which the tag 9 has by radio communication. On reading the identification information from the tag 9, the reader 12*b* outputs the information on the reader itself and the read identification information to the authentication device 10.

The authentication device 10 has the function disclosed in the first embodiment. The authentication device 10 has the function of shortening the waiting time of users in the hall 4. In order to realize these functions, the authentication device 10 includes a detection section 20 and a determination section 21 in addition to the list creation section 16, the determination section 17, the request output section 18, and the timer 19.

The list creation section 16 creates a service floors list in addition to an on-board passengers list, a waiting passengers list, and an alighting passengers list. A service floors list is created for each floor. In the service floors list, identification information of tags 9 and direction information are stored in a correlated manner. The direction information is information which shows in which direction the service floor of a person who carries a tag 9 is present as seen from the hall 4 where the person who carries the tag 9 is present. The direction information is determined on the basis of the service floor registered in a users list and the floor on which a tag 9 is present.

Consider, for example, the case where the users list shown in Table 1 is stored in the storage device 14. When a person who carries a tag 9 having the identification information "001" arrives at the hall 4 on the third floor, the identification information "001" and direction information expressing "up" are newly added to the service floors list of the third floor.

Table 2 shows an example of a service floors list.

TABLE 2

| Identification information | Direction |
|---|---|
| 001 | Up |
| 002 | Up |
| 003 | Down |

The detection section 20 detects the number of users present in the hall 4. For example, for each floor 4 the detection section 20 detects the number of users who move up and the number of users who move down. On the basis of identification information read by the reader 7, the detection section 20 performs the detection.

The determination section 21 determines whether or not the number of users detected by the detection section 20 has exceeded a threshold value. The threshold value is set beforehand on the basis of the rated number of passengers of the car 2. The threshold value may be set at the same value as the rated number of passengers of the car 2.

In the case where many users present in the same hall 4 are going to move to the same service floor, the request output section 18 outputs a request for adding an assigned car to the control device 1 (specifically, the control section 15). For example, when the determination section 21 determines that the number of users has exceeded the threshold value, the request output section 18 outputs a request for adding an assigned car to the control device 1. When the determination section 21 determines that the number of users has not exceeded the threshold value, the request output section 18 does not output the request.

Figure 4:
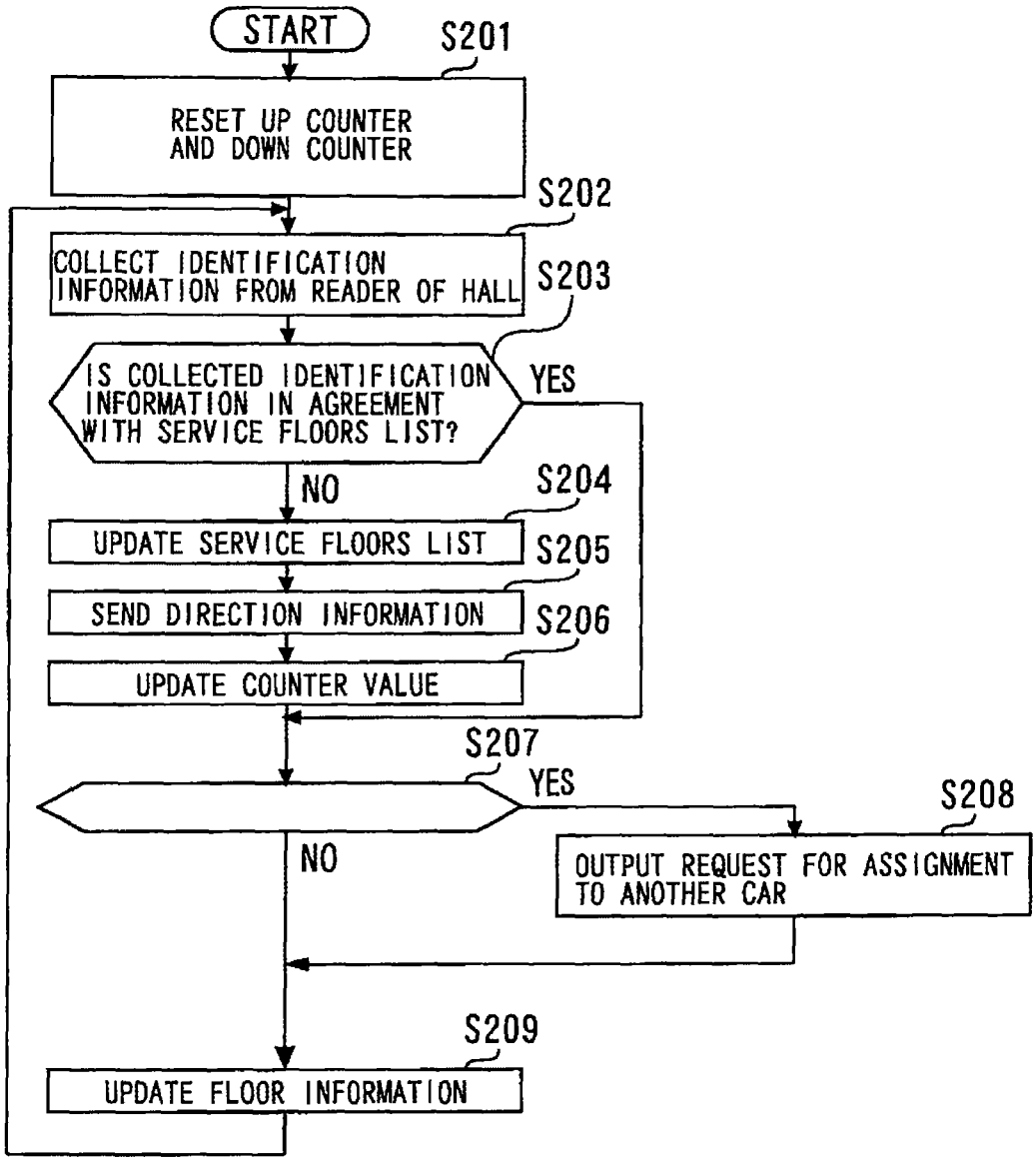
FIG. 4 is a flowchart showing actions of the elevator device according to the second embodiment of the present invention.

FIG. 4 is a flowchart showing actions of the elevator device according to the second embodiment of the present invention. In the following, referring to also FIG. 4, the contents of specific processing performed by the authentication device 10 will be described.

In the authentication device 10, the detection section 20 resets counters. Specifically, the detection section 20 sets the value of an up counter to 0. The detection section 20 sets the value of a down counter to 0 (S201).

When the resetting processing by the detection section 20 is completed, the authentication device 10 collects identification information from the reader 7 installed in the hall 4 (S202). The authentication device 10 acquires a service floors list from the storage device 14.

Next, the determination section 21 determines whether or not the identification information collected in S202 is in agreement with the identification information included in the service floors list (S203). Unless there are comings and goings of passengers in the hall 4, in S203 a determination is performed to the effect that the two are in agreement. In this case, the list creation section 16 does not update the service floors list. The processing by the authentication device 10 proceeds to the processing of S207.

When it is determined in S203 that the two are not in agreement, the list creation section 16 updates the service floors list (S204). For example, in the case where identification information not included in the service floors list is acquired in S202, the list creation section 16 adds the identification information to the service floors list. The list creation section 16 adds direction information to the service floors list by correlating the direction information to the identification information. Direction information is determined on the basis of the service floor registered in the users list and the floor for which the reading of the identification information has been performed. In the case where the identification information included in the service floors list was not acquired in S202, the list creation section 16 deletes the identification information from the service floors list. The list creation section 16 causes the storage device 14 to store the updated service floors list.

When direction information is added to the service floors list, the authentication device 10 sends the direction information to the control device 1 (S205). The detection section 20 updates the value of the counter on the basis of the direction information added to the service floors list (S206). For example, in the case where information on the upward direction is added to the service floors list, the detection section 20 adds 1 to the value of the up counter. In the case where information on the downward direction is added to the service floors list, the detection section 20 adds 1 to the value of the down counter.

Next, the determination section 21 makes a comparison between the counter value and the threshold value (S207). For example, the determination section 21 determines whether or not the value of the up counter has exceeded the threshold value. The determination section 21 determines whether or not the value of the down counter has exceeded the threshold value. In the case where the counter value is not more than the threshold value, the processing by the authentication device 10 proceeds to the processing of S209.

Here consider the case where group users newly arrive at the hall 4 when several users are already waiting for the arrival of the car 2 in the ball 4.

Calls for the users who were beforehand in the hall 4 have already been registered. The reader 7 installed in the hall 4 reads identification information from tags 9 of the users who have newly arrived at the hall 4. As a result of this, in S207 the determination section 21 determines that the counter value exceeded the threshold value.

When the counter value exceeds the threshold value, the request output section 18 outputs a request for the assignment to another car to the control device 1 (specifically, the control section 15) (S208). The request for the assignment to another car is a signal for assigning a new call to a car 2 different from the car 2 to which a call has already been assigned. When the value of the up counter exceeds the threshold value, the request output section 18 outputs to the control device 1 a request for the assignment to another car (upward). When the value of the down counter exceeds the threshold, the request output section 18 outputs to the control device 1 a request for the assignment to another car (downward). It is assumed that the car 2*a* has been assigned to users present beforehand in the hall 4. In this case, on receiving a request for the assignment to another car, the control section 15 causes the car 2*b* to run toward the hall 4.

The authentication device 10 performs the processing flow shown in S202 to S208 for each hall 4. For this reason, the authentication device 10 updates floor information in S209, and returns to the processing of S202.

With the elevator device having the above-described configuration, it is possible to shorten the waiting time of users in the hall 4. For this reason, the convenience of elevators is improved.

In this embodiment, the description was given of the authentication device 10 and the control device 1 as separate devices. However, this is an example. The authentication device 10 may be configured as part of the control device 1.

In addition, the up counter and the down counter may be provided for each car. In this case, on determining a car assigned to a call, the control device 1 outputs information on the assigned car to the authentication device 10. The detection section 20 updates the value of the counter in S206 on the basis of the information on the assigned car acquired from the control device 1.

Furthermore, the detection section 20 may detect the number of users present in the hall 4 on the basis of both the identification information read by the reader 7 and the identification information read by the reader 12. In this case, in S202 the authentication device 10 acquires a service floors list and an on-board passengers list from the storage device 14. The authentication device 10 calculates the number of on-board passengers of the car 2 on the basis of the acquired on-board passengers list. In S207 the determination section 21 makes a comparison using the following formula.

Counter value>threshold value−number of on-board passengers

With the elevator device having the above-described configuration, it is possible to add an assigned car also in consideration of the on-board passengers of the car 2. It is possible to further improve the operation efficiency and an elevator device excellent in convenience can be provided.

INDUSTRIAL APPLICABILITY

The elevator device of the present invention can be applied to an elevator device in which a reader is installed in a hall and a car of an elevator.

REFERENCE SIGNS LIST

1 control device
2 car
3 shaft
4 hall
5 machine room
6 hall button
7, 12 reader
8, 13 read range
9 tag
10 authentication device
11 destination call button
14 storage device
15 control section
16 list creation section
17 determination section
18 request output section
19 timer
20 detection section
21 determination section

The invention claimed is:

1. An elevator device comprising:

a first reader which is provided in a hall of an elevator and reads identification information which an information recording medium has;

a second reader which is provided in a car of the elevator and reads the identification information which the information recording medium has;

a request output section which outputs a registration request for a call to a control section of the elevator on the basis of the identification information read by the first reader; and a first determination section which, in the case where the identification information has been read by the first reader, determines whether or not the identification information has been read by the second reader before the reading of the identification information by the first reader, wherein the request output section does not output a registration request for a call corresponding to the identification information to the control section in the case where the first determination section determines that the identification information has been read by the second reader.

2. The elevator device according to claim 1, wherein in the case where the identification information has been read by the first reader, the first determination section determines whether or not the identification information has been read by the second reader within a given time immediately before the reading of the identification information by the first reader.

3. The elevator device according to claim 1, further comprising:

an authentication device which is connected to a control device of the elevator, wherein the control section is included in the control device, and wherein the request output section and the first determination section are included in the authentication device.

4. The elevator device according to claim 1, further comprising:

a detection section which detects the number of users present in the hall on the basis of reading results by the first reader; and a second determination section which determines whether or not the number of users detected by the detection section has exceeded a threshold value, wherein the request output section outputs a request for adding an assigned car to the control section in the case where the second determination section determines that the number of users has exceeded the threshold value.

5. The elevator device according to claim 4, wherein the detection section detects the number of users present in the hall on the basis of reading results by the first reader and reading results by the second reader.

6. The elevator device according to claim 4, wherein the detection section detects the number of users who move upward and the number of users who move downward, and wherein the second determination section determines whether or not the number of users who move upward and the number of users who move downward have each exceeded the threshold value.

7. An elevator device comprising:

a first reader which is provided in a hall of an elevator and reads identification information which an information recording medium has;

a second reader which is provided in a car of the elevator and reads the identification information which the information recording medium has;

a control section which performs a call registration on the basis of the identification information read by the first reader; and a first determination section which, in the case where the identification information has been read by the first reader, determines whether or not the identification information has been read by the second reader before the reading of the identification information by the first reader, wherein the control section does not perform a call registration corresponding to the identification information in the case where the first determination section determines that the identification information has been read by the second reader.

8. The elevator device according to claim 7, wherein in the case where the identification information has been read by the first reader, the first determination section determines whether or not the identification information has been read by the second reader within a given time immediately before the reading of the identification information by the first reader.

9. The elevator device according to claim 1, wherein the first reader reads the identification information by radio communication in the case where the information recording medium is present in a first read range, wherein the second reader reads the identification information by radio communication in the case where the information recording medium is present in a second read range, and wherein part of the first read range and part of the second read range overlap when the car stops at the hall.

10. The elevator device according to claim 7, wherein the first reader reads the identification information by radio communication in the case where the information recording medium is present in a first read range, wherein the second reader reads the identification information by radio communication in the case where the information recording medium is present in a second read range, and wherein part of the first read range and part of the second read range overlap when the car stops at the hall.

* * * * *